US009411264B1

(12) United States Patent
Yamada et al.

(10) Patent No.: US 9,411,264 B1
(45) Date of Patent: Aug. 9, 2016

(54) TONER ADJUSTING MECHANISM AND IMAGE FORMING APPARATUS

(71) Applicant: FUJI XEROX CO., LTD., Tokyo (JP)

(72) Inventors: Taichi Yamada, Kanagawa (JP); Kazutoshi Yatsuda, Kanagawa (JP); Kazunari Komatsuzaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/806,123

(22) Filed: Jul. 22, 2015

(30) Foreign Application Priority Data

Feb. 4, 2015 (JP) ..... 2015-020570

(51) Int. Cl.
*G03G 15/10* (2006.01)
*G03G 15/08* (2006.01)

(52) U.S. Cl.
CPC ..... *G03G 15/0825* (2013.01)

(58) Field of Classification Search
USPC ..... 399/58, 61
See application file for complete search history.

(56) References Cited

U.S. PATENT DOCUMENTS 6,603,934 B2 * 8/2003 Shimmura ..... G03G 15/104 399/46
6,819,888 B2 * 11/2004 Teraoka ..... G03G 15/104 399/57
8,150,285 B2 * 4/2012 Izawa ..... G03G 15/556 399/237
2003/0175049 A1 * 9/2003 Ichida ..... G03G 21/12 399/237
2009/0175642 A1 7/2009 Izawa et al.

FOREIGN PATENT DOCUMENTS

JP 2003-167442 A 6/2003
JP 2009-163124 A 7/2009
JP 2011-175210 A 9/2011

* cited by examiner

*Primary Examiner* — David Gray
*Assistant Examiner* — Warren K Fenwick
(74) *Attorney, Agent, or Firm* — Oliff PLC

(57) ABSTRACT

Provided is a toner adjusting mechanism, including a storage section in which a liquid developer is stored, a supply section that causes the liquid developer which is stored in the storage section to flow at a predetermined flow velocity to supply the liquid developer to a developer tank, a circulating section that causes the liquid developer which is discharged from the storage section to flow and circulate at a flow velocity faster than the flow velocity of the liquid developer which flows in the supply section, a detecting section that detects a toner concentration of the liquid developer which flows in the circulating section, and an addition section that adds an adjustment agent which adjusts the toner concentration of the liquid developer to the liquid developer which is stored in the storage section.

6 Claims, 9 Drawing Sheets

TONER ADJUSTING MECHANISM AND IMAGE FORMING APPARATUS

CROSS-REFERENCE TO RELATED APPLICATIONS

This application is based on and claims priority under 35 USC 119 from Japanese Patent Application No. 2015-020570 filed Feb. 4, 2015.

BACKGROUND

Technical Field

The invention relates to a toner adjusting mechanism and an image forming apparatus.

SUMMARY

According to an aspect of the invention, there is provided a toner adjusting mechanism, including:

a storage section in which a liquid developer, which is collected from a holding member that revolves with holding the liquid developer, is stored;

a supply section that causes the liquid developer which is stored in the storage section to flow at a predetermined flow velocity to supply the liquid developer to a developer tank;

a circulating section that causes the liquid developer which is discharged from the storage section to flow and circulate at a flow velocity faster than the flow velocity of the liquid developer which flows in the supply section;

a detecting section that detects a toner concentration of the liquid developer which flows in the circulating section; and an addition section that adds an adjustment agent which adjusts the toner concentration of the liquid developer to the liquid developer which is stored in the storage section.

BRIEF DESCRIPTION OF THE DRAWINGS

Exemplary embodiments of the present invention will be described in detail based on the following figures, wherein.

DETAILED DESCRIPTION

Figure 1:
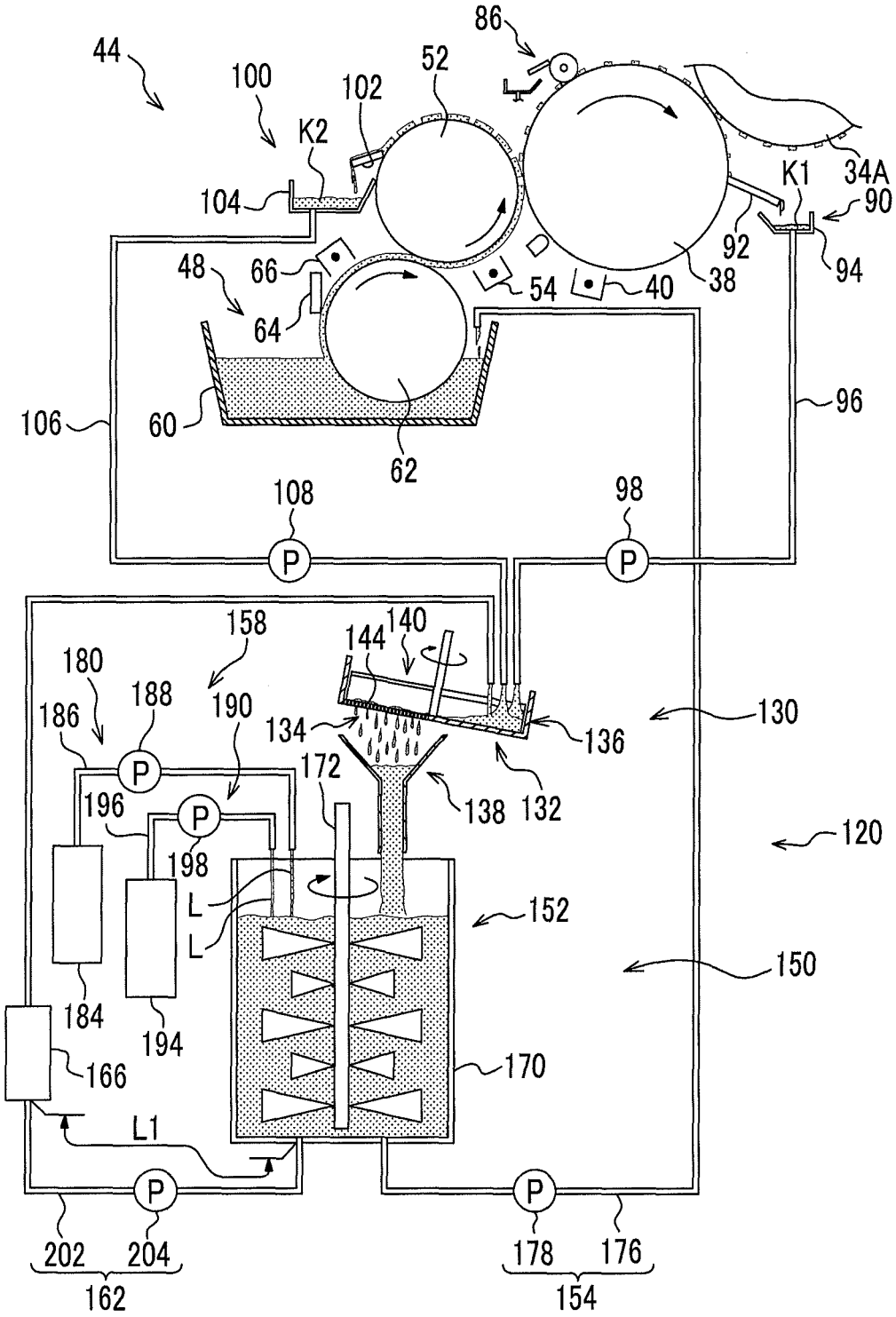
FIG. 1 is a configuration diagram illustrating a toner adjusting mechanism and the like according to an exemplary embodiment of the invention.

A toner adjusting mechanism according to an exemplary embodiment of the invention and an example of an image forming apparatus will be described according to FIGS. 1 to 9. Note that, an arrow H depicted in the drawings indicates the vertical direction (a plumb direction) of the apparatus, an arrow W indicates the width direction (a horizontal direction) of the apparatus, and an arrow D indicates the depth direction (a horizontal direction) of the apparatus.

Overall Configuration

Figure 8:
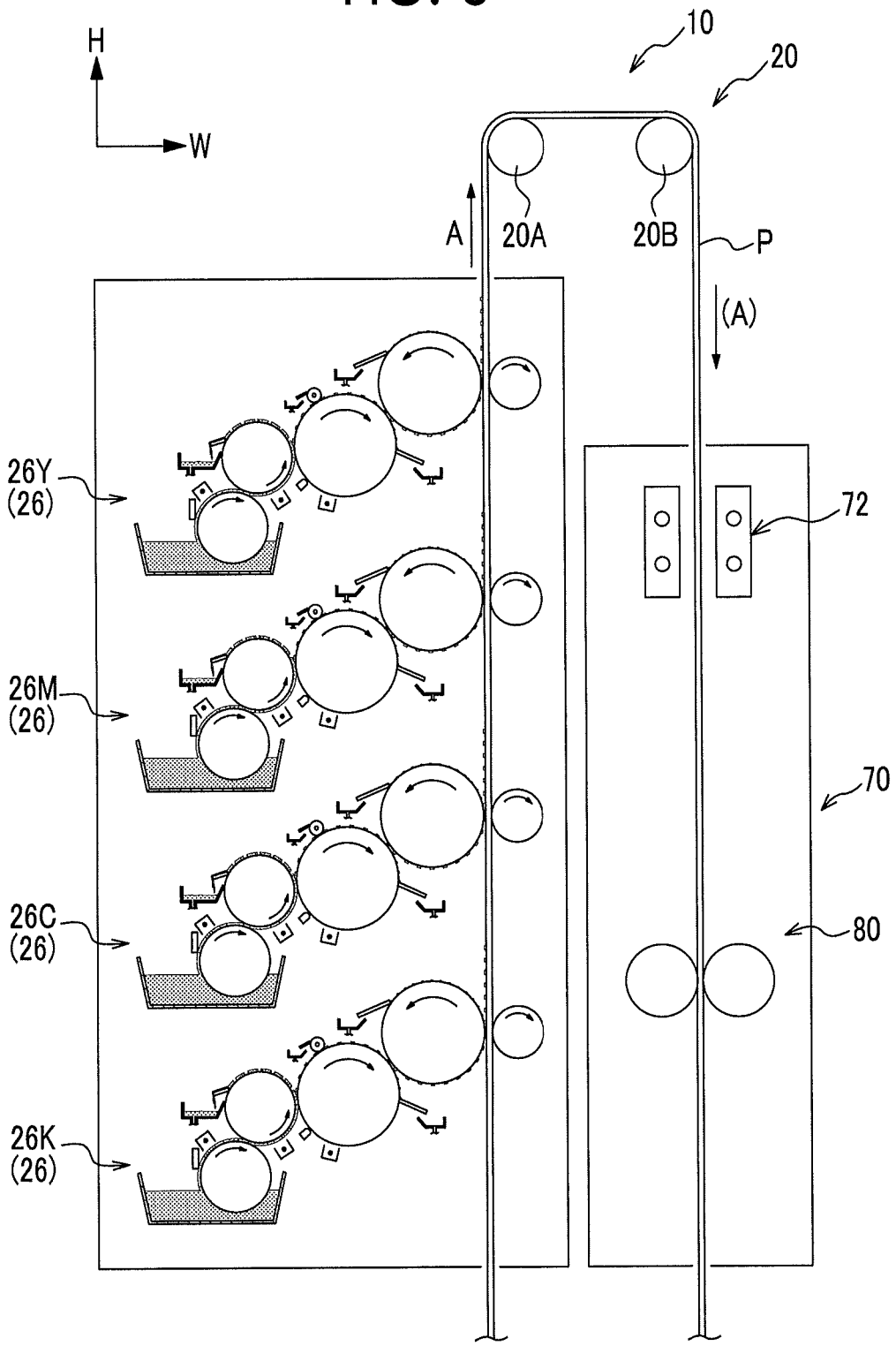
FIG. 8 is a configuration diagram illustrating the image forming apparatus according to the exemplary embodiment of the invention.

An image forming apparatus 10 is an apparatus which forms an image on continuous paper P as a recording medium using a liquid-state type of liquid developer G which is obtained by dispersing a powder toner in a nonvolatile oil. As illustrated in FIG. 8, the image forming apparatus 10 is provided with a transporting section 20, an image forming section 26 which forms a toner image, and a fixing device 70. The transporting section 20 transports the continuous paper P, and the fixing device 70 fixes a toner image to the continuous paper P. In order to reuse the liquid developer G, the image forming apparatus 10 is provided with a toner adjusting mechanism 120. The toner adjusting mechanism 120 adjusts the toner concentration of the liquid developer G which is collected from the image forming section 26. Note that, the toner adjusting mechanism 120 will be described later.

Transporting Section

The transporting section 20 is configured to transport the continuous paper P at a predetermined transport speed in an arrow A direction (hereinafter referred to as a "medium transport direction") in the drawings, and is provided with a pair of transport rollers 20A and 20B.

Image Forming Section

The image forming section 26 is provided with an image forming section 26Y, an image forming section 26M, an image forming section 26C, and an image forming section 26K. The image forming section 26Y forms a yellow (Y) image, the image forming section 26M forms a magenta (M) image, the image forming section 26C forms a cyan (C) image, and the image forming section 26K forms a black (K) image. The image forming section 26K, the image forming section 26C, the image forming section 26M, and the image forming section 26Y are disposed in this order from the upstream side in the medium transport direction. In the description hereinafter, when there is no particular need to distinguish therebetween, the letters "Y", "M", "C", and "K" will be omitted from the end of the reference numeral.

Figure 7:
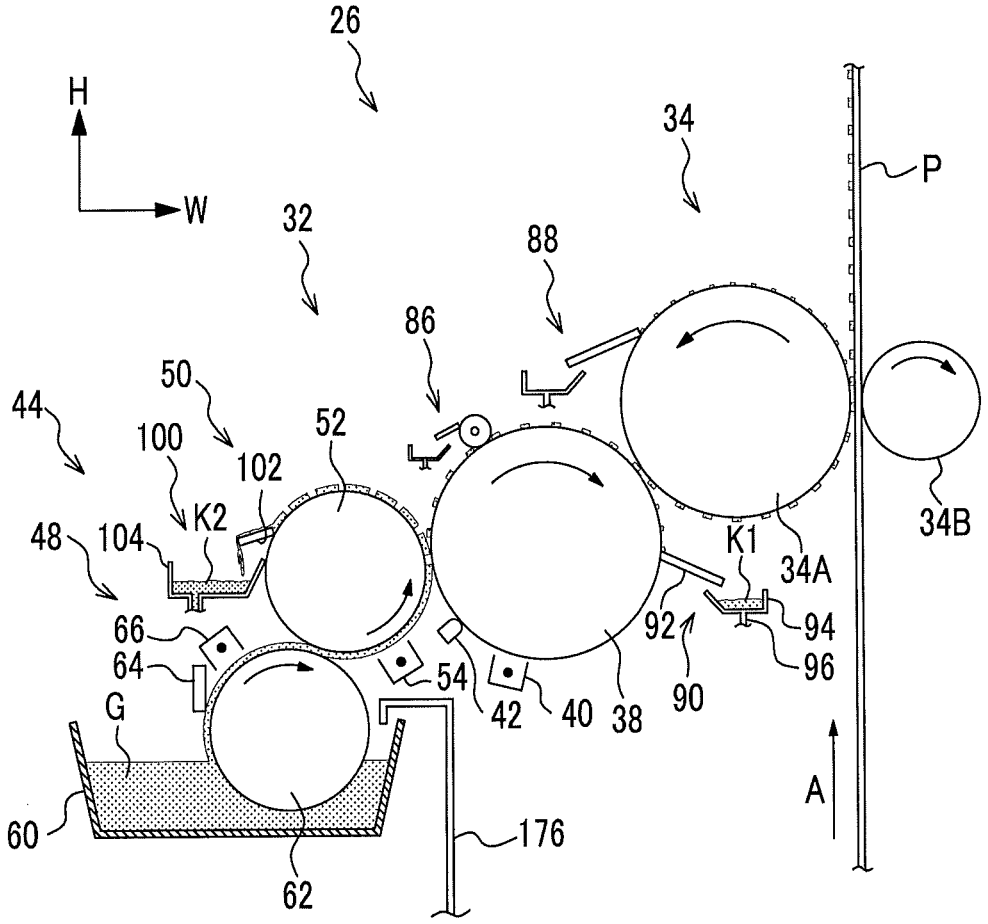
FIG. 7 is a configuration diagram illustrating an image forming section which is provided in the image forming apparatus according to the exemplary embodiment of the invention.

As illustrated in FIG. 7, the image forming section 26 is provided with an image forming unit 32 and a transfer unit 34. The image forming unit 32 is for forming a toner image, and the transfer unit 34 is for transferring the toner image to the continuous paper P.

Image Forming Unit

The image forming unit 32 is provided with an image holding member 38, a charging device 40, and an exposure device 42. The image holding member 38 holds the toner image, the charging device 40 charges the image holding member 38, and the exposure device 42 irradiates the image holding member 38 with an exposure beam to form an electrostatic latent image. The image forming unit 32 is provided with a developing machine 44. The developing machine 44 transfers the liquid developer G to the image holding member 38 and develops the electrostatic latent image of the image holding member 38 as the toner image.

The image forming unit 32 is provided with a removal member 86 and a collecting mechanism 90. The removal member 86 removes the oil contained in the liquid developer G from the liquid developer G of the image holding member 38 before the toner image is transferred to a transfer roll 34A, and the collecting mechanism 90 collects the liquid developer G that remains on the image holding member 38. Note that, the collecting mechanism 90 will be described later.

Developing Machine

The developing machine 44 is provided with a developing section 50 and a supply section 48. The developing section 50 transfers the liquid developer G to the electrostatic latent image which is formed on the image holding member 38, and the supply section 48 supplies the liquid developer G to the developing section 50.

The developing section 50 is provided with a developing roll 52 and a charging member 54. The developing roll 52 is an example of a developing member which rotates (revolves). The developing section 50 is provided with a collecting mechanism 100. The collecting mechanism 100 collects the liquid developer G which remains on the developing roll 52. Note that, the collecting mechanism 100 will be described later.

Supply Section

The supply section 48 is provided with a developer tank 60 and a supply roll 62. The liquid developer G is stored in the developer tank 60, and the supply roll 62 takes on the liquid developer G from the developer tank 60 and supplies the liquid developer G to the developing roll 52. The supply section 48 is provided with a blade 64 and a charging device 66. The blade 64 adjusts a film of the liquid developer G that is adhered to the supply roll 62.

Transfer Unit

The transfer unit 34 is provided with the transfer roll 34A and a backup roll 34B. The transfer roll 34A is an example of an intermediate holding member, and the backup roll 34B is an example of a transfer member which is disposed on the opposite side from the transfer roll 34A. The transfer unit 34 is provided with a collecting mechanism 88. The collecting mechanism 88 collects, from the transfer roll 34A, the liquid developer G which is not transferred to the continuous paper P from the transfer roll 34A and remains on the transfer roll 34A.

Fixing Device

As illustrated in FIG. 8, the fixing device 70 is provided with a heating section 72 and a fixing section 80. The heating section 72 heats the continuous paper P, and the fixing section 80 fixes the toner image to the continuous paper P.

Operations of Overall Configuration

The supply roll 62 which is rotationally driven takes the liquid developer G which is stored in the developer tank 60. The liquid developer G which is taken by the supply roll 62 is supplied to the developing roll 52 (refer to FIG. 7).

The charging member 54 charges the toner contained in the liquid developer G which is supplied to the developing roll 52, and the liquid developer G containing the charged toner is transferred from the developing roll 52 to the electrostatic latent image which is formed on the image holding member 38. The electrostatic latent image is developed as the toner image by the developing machine 44.

The toner image which is formed on the image holding member 38 which rotates is primarily transferred to the transfer roll 34A. The toner image which is primarily transferred to the transfer roll 34A is transferred to the continuous paper P which is transported. In this case, the oil moves (is transferred) to the continuous paper P together with the toner image. This process is performed by the image forming section 26 of each color, and a toner image in which the colors are superimposed on each other is formed on the continuous paper P.

The oil of the continuous paper P which is transported is removed by the fixing device 70, and the toner image is fixed to the continuous paper P (refer to FIG. 8).

Configuration of Main Parts

Next, description will be given of the collecting mechanism 90, the collecting mechanism 100, and the toner adjusting mechanism 120.

Collecting Mechanism

As illustrated in FIG. 1, the collecting mechanism 90 is provided with a scraping blade 92 and a collecting member 94. The scraping blade 92 scrapes, from the image holding member 38, the liquid developer G which is not transferred from the image holding member 38 to the transfer roll 34A and remains on the image holding member 38, and the collecting member 94 collects the liquid developer G which is scraped off. The collecting mechanism 90 is provided with a transporting pipe 96 and a pump 98, which are for transporting the liquid developer G which is collected in the collecting member 94 to a receiving section 132 (described later). In the description hereinafter, the liquid developer G which is scraped off by the scraping blade 92 will be referred to as a first collected agent K1.

Accordingly, the pump 98 causes the first collected agent K1 to flow within the transporting pipe 96 such that the first collected agent K1 is discharged to the receiving section 132.

The collecting mechanism 100 is provided with a scraping blade 102 and a collecting member 104. The scraping blade 102 scrapes, from the developing roll 52, the liquid developer G which is not transferred from the developing roll 52 to the image holding member 38 and remains on the developing roll 52, and the collecting member 104 collects the liquid developer G which is scraped off. The collecting mechanism 100 is provided with a transporting pipe 106 and a pump 108, which are for transporting the liquid developer G which is collected in the collecting member 104 to the receiving section 132 (described later). In the description hereinafter, the liquid developer G which is scraped off by the scraping blade 102 will be referred to as a second collected agent K2.

Accordingly, the pump 108 causes the second collected agent K2 to flow within the transporting pipe 106 such that the second collected agent K2 is discharged to the receiving section 132.

Toner Adjusting Mechanism

As illustrated in FIG. 1, the toner adjusting mechanism 120 is provided with a dispersing device 130 and a concentration adjusting device 150. The dispersing device 130 disperses the toner aggregate which is contained in the first collected agent K1 and the second collected agent K2, and the concentration adjusting device 150 adjusts the toner concentration. Note that, the toner aggregate is an aggregate of toner which is formed as a result of toner (toner particles) becoming electrically charged due to being charged by the charging members 54, 66, or the like. In the description hereinafter, when not particularly distinguishing between the first collected agent K1 and the second collected agent K2, there is a case in which the first collected agent K1 and the second collected agent K2 will be collectively referred to as the collected agent K.

Dispersing Device

Figure 2:
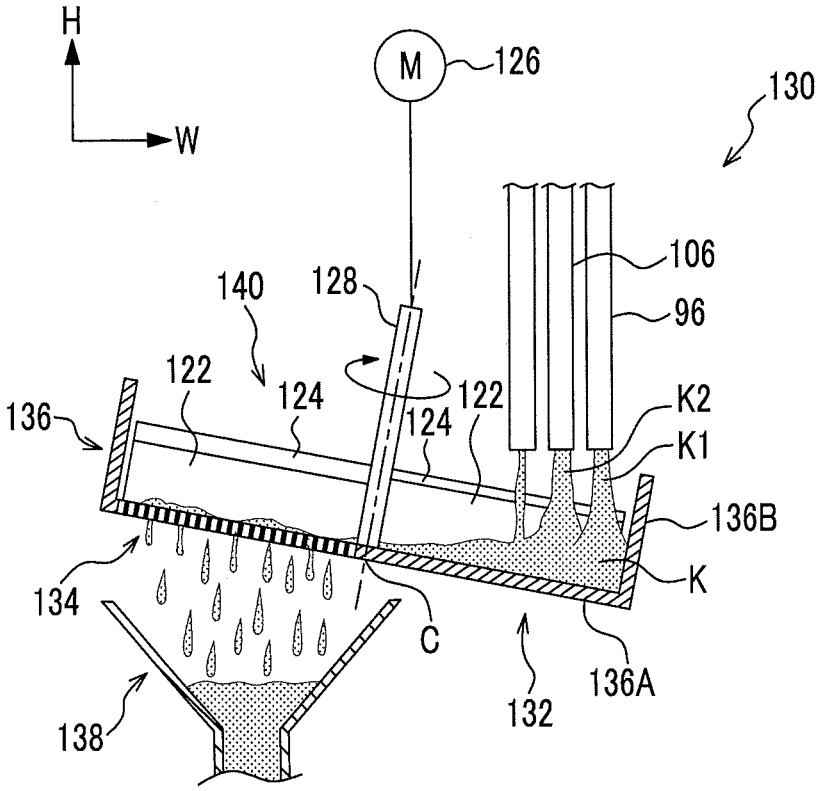
FIG. 2 is a side view illustrating a dispersing device which is provided in the toner adjusting mechanism according to the exemplary embodiment of the invention.

As illustrated in FIG. 2, the dispersing device 130 is provided with a container 136 and a transporting member 140. The receiving section 132 which receives the collected agent K and a porous section 134 through which the collected agent K passes are formed in the container 136, and the transporting member 140 transports the collected agent K within the container 136. The dispersing device 130 is provided with a funnel member 138. The funnel member 138 gathers the collected agent K which passes through the porous section 134.

Figure 3:
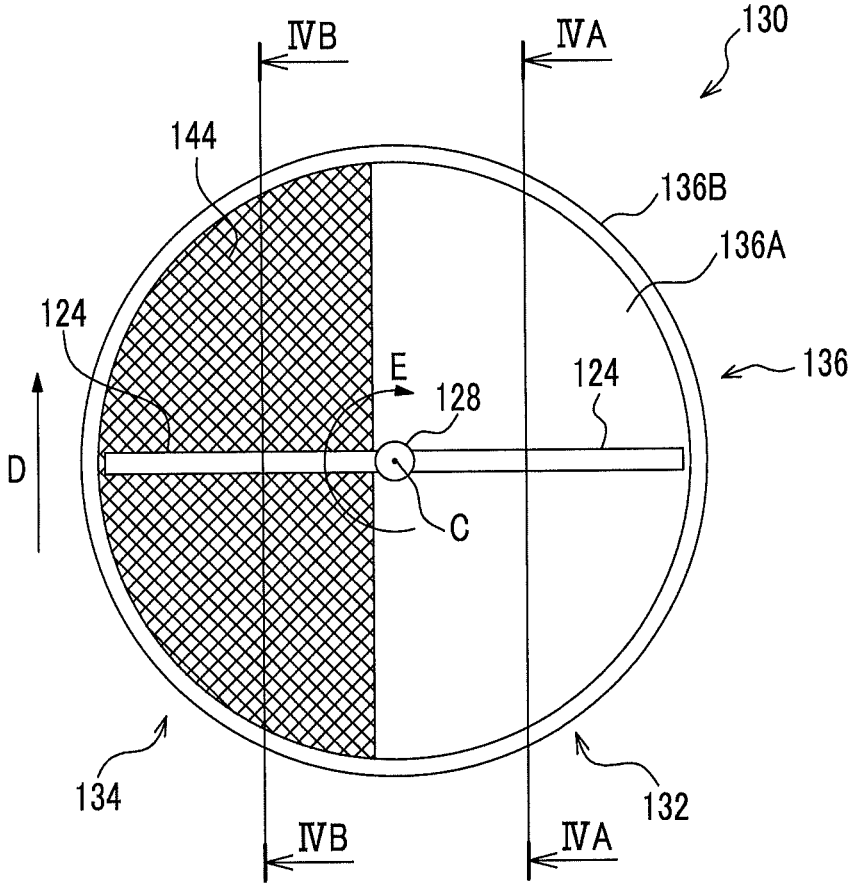
FIG. 3 is a diagram illustrating the dispersing device which is provided in the toner adjusting mechanism according to the exemplary embodiment of the invention, as viewed from an axial direction of a rotating shaft member.

As illustrated in FIGS. 2 and 3, the container 136 is formed to include a bottom plate 136A and a side plate 136B. The bottom plate 136A is circular, and the side plate 136B stands from the circumferential edge of the bottom plate 136A to the top side. The container 136 is disposed such that the bottom plate 136A is inclined in relation to the horizontal plane.

A portion of the bottom plate 136A in the container 136 on the bottom side in relation to a center C thereof (the right side in the drawing) is the receiving section 132, and a portion on the top side in relation to the center C (the left side in the drawing) is the porous section 134. The receiving section 132 is disposed on the bottom side of the exit ports (reference numeral omitted) of the transporting pipes 96 and 106, and the receiving section 132 is configured to receive the collected agent K which is discharged from the transporting pipes 96 and 106.

The porous section 134 includes a mesh member 144 (a mesh) through which the collected agent K passes. Specifically, the mesh member 144 is formed in the bottom plate 136A by rendering the portion of the top side of the container 136 in relation to the center C mesh shaped. The funnel member 138 which gathers the collected agent K which passes through the mesh member 144 is disposed beneath the porous section 134.

The transporting member 140 is provided with a rotating shaft member 128, a pair of plate members 122, and a motor 126. The rotating shaft member 128 extends in the plumb direction from the center C of the container 136 to the bottom plate 136A, the pair of plate members 122 are disposed, one on each side of the rotating shaft member 128, to interpose the rotating shaft member 128, and the motor 126 applies a rotating force to the rotating shaft member 128.

The rotating shaft member 128 cylindrically shaped, and a pair of support members 124 (refer to FIGS. 4A and 4B), the cross sections of which form an L-shape from the outer circumferential surface of the rotating shaft member 128, are attached to the rotating shaft member 128 so as to extend to the outside in the radial direction of the rotating shaft member 128. The pair of support members 124 is disposed to interpose the rotating shaft member 128.

Figure 4B:
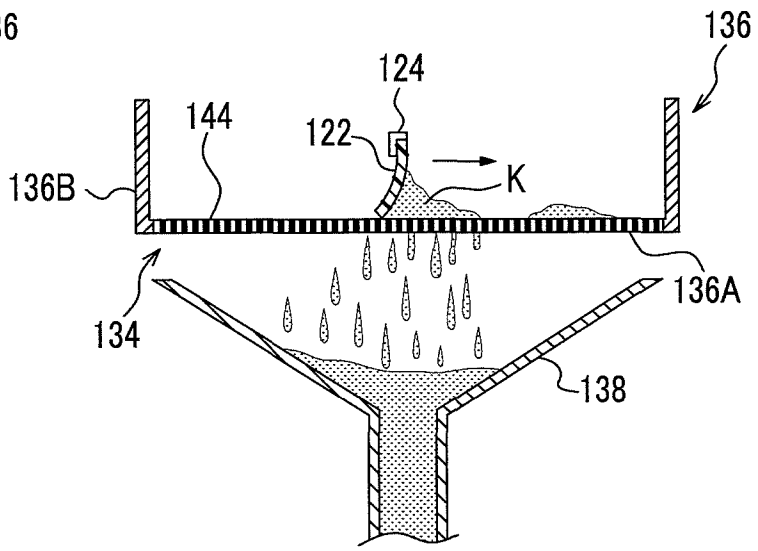
FIGS. 4A and 4B are cross-sectional diagrams illustrating the dispersing device which is provided in the toner adjusting mechanism according to the exemplary embodiment of the invention.
Figure 4A:
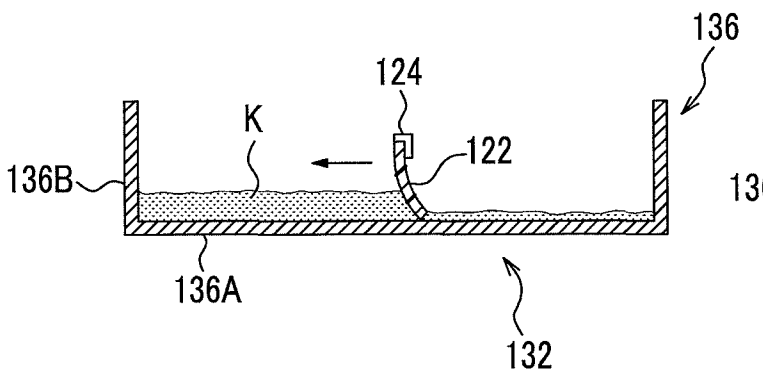

FIG. 4A is a diagram illustrating the cross section taken across the line IVA-IVA in FIG. 3, and FIG. 4B is a diagram illustrating the cross section taken across the line IVB-IVB in FIG. 3. As illustrated in FIGS. 4A and 4B, in each of the support members 124, the portion of the top end side of the plate member 122 is fixed by a fixing unit (not shown), and each of the support members 124 supports the respective plate member 122.

The plate member 122 is formed using an elastic member (for example, a rubber material), and the outer appearance is rectangular. The plate member 122 is elastically deformed in a curved shape which is convex in the direction of procession as viewed from the radial direction of the rotating shaft member 128 due to the portion of the bottom end side of the plate member 122 being attached in contact with the bottom plate 136A.

In this configuration, when the motor 126 applies a rotational force to the rotating shaft member 128, the pair of plate members 122 revolves (moves) in one direction (the arrow E direction in FIG. 3). As illustrated in FIGS. 3 and 4A, in the receiving section 132, the plate member 122 which revolves is configured to transport the collected agent K which is received by the receiving section 132 toward the porous section 134. Meanwhile, as illustrated in FIG. 4B, in the porous section 134, the plate member 122 which revolves is configured to rub off the collected agent K which is transported onto the mesh member 144 to cause the collected agent K to pass through the mesh member 144. The collected agent K which passes through the mesh member 144 is gathered by the funnel member 138, and the collected agent K which is gathered by the funnel member 138 is stored in a storage section 152 (described later).

Concentration Adjusting Device

As illustrated in FIG. 1, the concentration adjusting device 150 is provided with the storage section 152, a supply section 154, and an addition section 158. The collected agent K which is gathered by the funnel member 138 is stored in the storage section 152, the supply section 154 is for supplying the collected agent K to the developer tank 60 of the developing machine 44, and the addition section 158 adds an adjustment agent L to the collected agent K.

The concentration adjusting device 150 is provided with a circulating section 162 and a detecting section 166 (for example an ultrasonic concentration sensor). The circulating section 162 is for causing the collected agent K which is discharged from the storage section 152 to circulate, and the detecting section 166 detects the toner concentration of the collected agent K which flows in the circulating section 162.

Storage Section

Storage Section

The storage section 152 is provided with a storage tank 170 and an agitation member 172. The storage tank 170 is a container in which the collected agent K which is gathered by the funnel member 138 is stored, and the agitation member 172 agitates the collected agent K within the storage tank 170 to render the toner concentration of the collected agent K uniform.

Supply Section

The supply section 154 is provided with a supply pipe 176 and a pump 178, which are for supplying the collected agent K which is stored in the storage tank 170 to the developer tank 60. The pump 178 causes the collected agent K to flow within the supply pipe 176 at a predetermined flow velocity (hereinafter referred to as the "first flow velocity"), and supplies the collected agent K to the developer tank 60. Note that, when the pipe diameter of the supply pipe 176 is 10 mm, the first flow velocity is 42 mm/s.

Circulating Section

The circulating section 162 is provided with a return pipe 202 and a pump 204, which are for causing the collected agent K to be discharged from the storage tank 170 and causing the collected agent K to circulate via the dispersing device 130. The pump 204 causes the collected agent K to flow within the return pipe 202 at a second flow velocity which is faster than the first flow velocity, and causes the collected agent K to circulate via the dispersing device 130. Note that, when the pipe diameter of the return pipe 202 is 10 mm, the second flow velocity is 106 mm/s.

Detection Section

The detecting section 166 is disposed part way down the return pipe 202, and the detecting section 166 is configured to detect the toner concentration of the collected agent K which flows within the return pipe 202. Here, the detecting section 166 is disposed in a position at which the flow path length of the return pipe 202 from the storage tank 170 is L1 (refer to FIG. 1).

Addition Section

The addition section 158 is provided with a first mechanism 180 and a second mechanism 190.

The first mechanism 180 is provided with a container 184, a transporting pipe 186, and a pump 188. The oil which is the dispersion medium is stored in the container 184 as the adjustment agent L, and the transporting pipe 186 and the pump 188 are for transporting the adjustment agent L which is stored in the container 184 to the storage tank 170. Accordingly, the pump 188 is configured to cause the adjustment agent L to flow within the transporting pipe 186, and to add the adjustment agent L to the collected agent K which is stored in the storage tank 170.

Meanwhile, the second mechanism 190 is provided with a container 194, a transporting pipe 196, and a pump 198. A high concentration developer which has a higher toner concentration than a predetermined reference toner concentration is stored in the container 194 as the adjustment agent L, and the transporting pipe 196 and the pump 198 are for transporting the adjustment agent L which is stored in the container 194 to the storage tank 170. Accordingly, the pump 198 is configured to cause the adjustment agent L to flow within the transporting pipe 196, and to add the adjustment agent L to the collected agent K which is stored in the storage tank 170.

Figure 5:
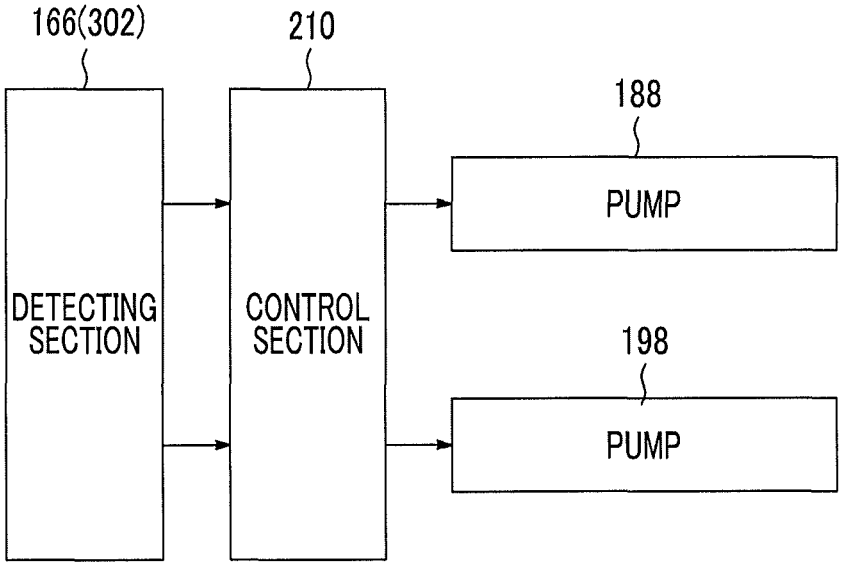
FIG. 5 is a block diagram illustrating an information transmission path of a control section which is provided in the toner adjusting mechanism according to the exemplary embodiment of the invention.
Figure 6:
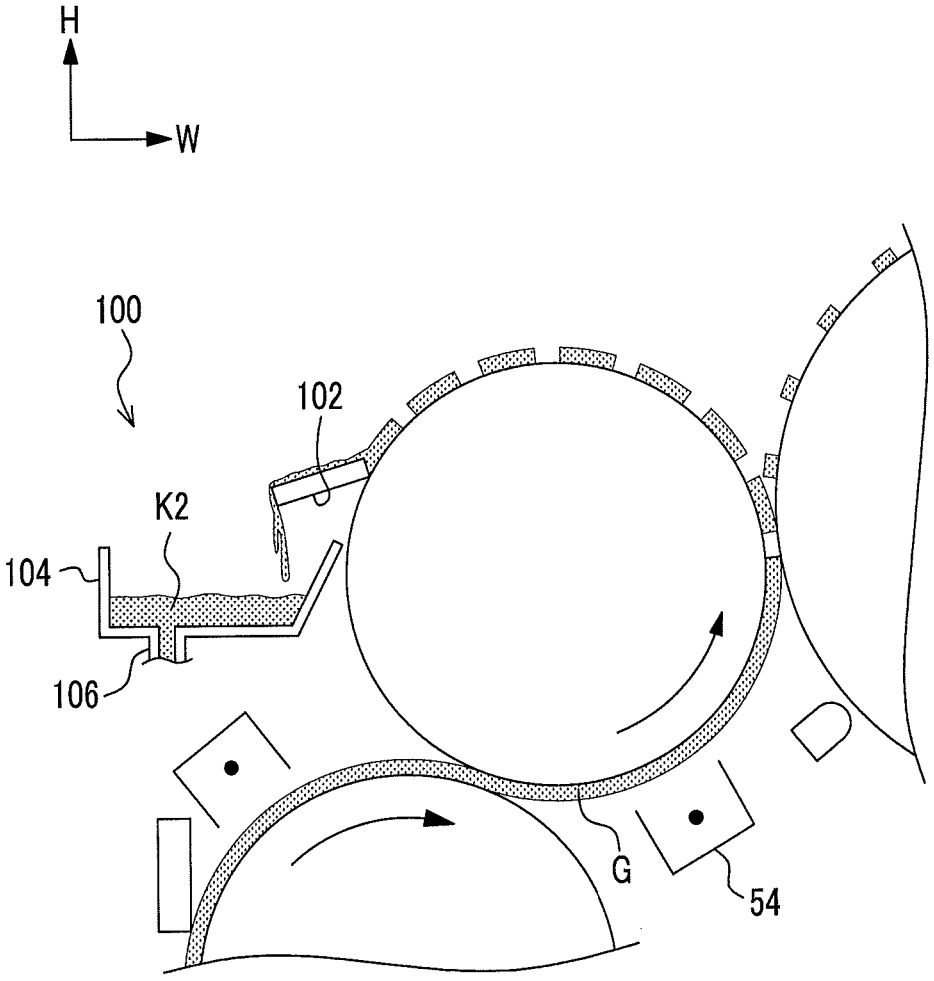
FIG. 6 is a configuration diagram illustrating a collecting mechanism which is provided in an image forming apparatus according to the exemplary embodiment of the invention.

The addition section 158 controls the pumps 188 and 198 based on the detection results of the detecting section 166, and is provided with a control section 210 (refer to FIG. 5). The control section 210 adds the adjustment agent L to the collected agent K which is stored in the storage tank 170. Note that, the specific configuration of the control section 210 will be described later, together with the operations.

Operations of Main Parts

Next, description will be given of the operations of the main parts in comparison with a comparative embodiment in relation to the exemplary embodiment.

First, description will be given of a toner adjusting mechanism 300 according to the comparative embodiment. Note that, description will be given of mainly the parts of the toner adjusting mechanism 300 according to the comparative embodiment which differ from those of the toner adjusting mechanism 120 according to the exemplary embodiment.

Figure 9:
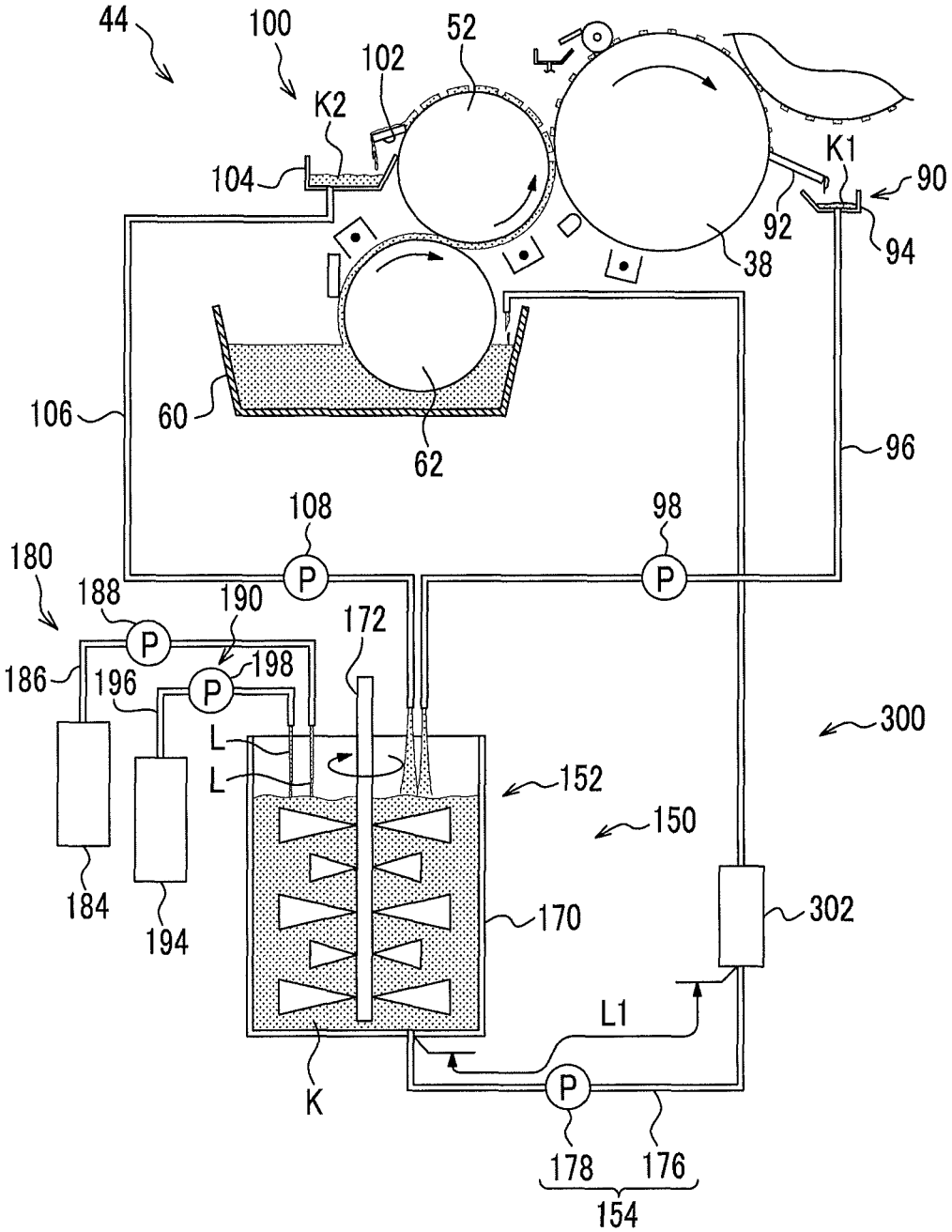
FIG. 9 is a configuration diagram illustrating a toner adjusting mechanism and the like according to a comparative embodiment in relation to exemplary embodiment of the invention.

As illustrated in FIG. 9, the toner adjusting mechanism 300 is not provided with a dispersing device which disperses the toner aggregate which is contained in the collected agent K. Accordingly, the first collected agent K1 which is collected from the image holding member 38 and the second collected agent K2 which is collected from the developing roll 52 are directly discharged to the storage tank 170. The toner adjusting mechanism 300 is not provided with a circulating section for causing the collected agent K which is discharged from the storage tank 170 to circulate. A detecting section 302 which detects the toner concentration of the collected agent K is disposed part way down the supply pipe 176.

Here, the detecting section 302 is disposed in a position at which the flow path length of the supply pipe 176 from the storage tank 170 is L1 (refer to FIG. 9). In other words, in the exemplary embodiment, the flow path length from the storage tank 170 to the detecting section 166 is set to be equal to the flow path length from the storage tank 170 to the detecting section 302 in the comparative embodiment.

In this configuration, the first collected agent K1 which is collected from the image holding member 38 and the second collected agent K2 which is collected from the developing roll 52 flow within the transporting pipes 96 and 106, and are directly discharged to the storage tank 170. The agitation member 172 which rotates agitates the collected agent K which is stored in the storage tank 170 and renders the toner concentration of the collected agent K uniform.

The pump 178 causes the collected agent K to flow within the supply pipe 176 at the first flow velocity, and supplies the collected agent K to the developer tank 60. Here, the detecting section 302 which is disposed part way down the supply pipe 176 detects the toner concentration of the collected agent K which flows within the supply pipe 176. The control section 210 (refer to FIG. 5) adds the adjustment agent L to the collected agent K which is stored in the storage tank 170 by controlling the driving and non-driving of the pump 188, and the driving and non-driving of the pump 198 based on the detection results of the detecting section 302. Accordingly, the toner concentration of the collected agent K is adjusted to obtain the predetermined reference toner concentration.

The collected agent K which is set to the predetermined reference toner concentration flows within the supply pipe 176 and is supplied to the developer tank 60.

Next, description will be given of the operations of the toner adjusting mechanism 120 according to the exemplary embodiment.

In the toner adjusting mechanism 120, the first collected agent K1 which is collected from the image holding member 38 and the second collected agent K2 which is collected from the developing roll 52 flow in the transporting pipes 96 and 106, and are discharged to the receiving section 132 (refer to FIGS. 1 and 2). The receiving section 132 receives the collected agent K which is discharged from the transporting pipes 96 and 106.

As illustrated in FIGS. 3 and 4A, in the receiving section 132, the plate member 122 which revolves is configured to transport the collected agent K from the receiving section 132 toward the porous section 134. As illustrated in FIG. 4B, in the porous section 134, the plate member 122 which revolves is configured to rub off the collected agent K which is transported onto the mesh member 144 to cause the collected agent K to pass through the mesh member 144. The toner aggregate contained in the collected agent K is dispersed due to the plate member 122 rubbing off the collected agent K onto the mesh member 144.

The collected agent K in which the toner aggregate is dispersed is gathered by the funnel member 138, and is stored in a storage tank 170 as illustrated in FIG. 1. The agitation member 172 which rotates agitates the collected agent K which is stored in the storage tank 170 and renders the toner concentration of the collected agent K uniform.

The pump 178 causes the collected agent K to flow within the supply pipe 176 at the first flow velocity, and supplies the collected agent K to the developer tank 60. The pump 204 causes the collected agent K to flow within the return pipe 202 at a second flow velocity which is faster than the first flow velocity, and discharges the collected agent K to the receiving section 132.

Here, the detecting section 166 which is disposed part way down the return pipe 202 detects the toner concentration of the collected agent K which flows within the return pipe 202. The control section 210 (refer to FIG. 5) adds the adjustment agent L to the collected agent K which is stored in the storage tank 170 by controlling the driving and non-driving of the pump 188, and the driving and non-driving of the pump 198 based on the detection results of the detecting section 166. Accordingly, the toner concentration of the collected agent K is adjusted to obtain the predetermined reference toner concentration.

The collected agent K which is set to the predetermined reference toner concentration flows within the supply pipe 176 and is supplied to the developer tank 60.

SUMMARY

As described above, the detecting section 302 of the toner adjusting mechanism 300 according to the comparative embodiment detects the toner concentration of the collected agent K which flows within the supply pipe 176 at the first flow velocity. Meanwhile, the detecting section 166 of the toner adjusting mechanism 120 according to the exemplary embodiment detects the toner concentration of the collected agent K which flows within the return pipe 202 at the second flow velocity which is faster than the first flow velocity.

Here, as described earlier, in the exemplary embodiment, the flow path length from the storage tank 170 to the detecting section 166 is set to be equal to the flow path length from the storage tank 170 to the detecting section 302 in the comparative embodiment. Therefore, the detecting section 166 detects the toner concentration of the collected agent K which is stored in the storage tank 170 sooner than the detecting section 302.

Accordingly, in the toner adjusting mechanism 120, inconsistencies in the toner concentration of the collected agent K which is supplied to the developer tank 60 are suppressed in comparison to in the toner adjusting mechanism 300.

The toner adjusting mechanism 120 is provided with the dispersing device 130 which disperses the toner aggregate which is contained in the collected agent K, and the toner adjusting mechanism 300 is not provided with a dispersing device. In this manner, the toner aggregate is dispersed in the toner adjusting mechanism 120. In the toner adjusting mechanism 120, since the toner aggregate is dispersed, the toner concentration in the storage tank 170 is uniform.

In the image forming apparatus 10, density irregularities occurring in the output image are suppressed due to the suppression of inconsistencies in the toner concentration of the collected agent K which is supplied to the developer tank 60.

Note that, detailed description of the specific exemplary embodiment of the invention is given; however, the invention is not limited to the exemplary embodiment, and it is obvious to a person skilled in the art that it is possible to adopt various other exemplary embodiments within the scope of the invention. For example, in the exemplary embodiment, the remaining liquid developer G from the image holding member 38 and the developing roll 52 is collected; however, the remaining liquid developer G may be collected from either one of the image holding member 38 and the developing roll 52.

In the exemplary embodiment, the toner adjusting mechanism 120 is provided with the dispersing device 130; however, in particular, the dispersing device 130 may not be provided. However, in this case, the operations of the dispersing device 130 are no longer obtained.

In the exemplary embodiment, the pump 204 causes the collected agent K to flow within the return pipe 202, and causes the collected agent K to be circulated via the dispersing device 130; however, the collected agent K may be circulated without passing through the dispersing device 130.

In the exemplary embodiment, while not particularly described, the collected developer (the oil and the like) which is collected by the removal member 86 may be collected in the container 136.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner adjusting mechanism, comprising:

a storage section in which a liquid developer collected from a holding member surface is stored, the holding member moving while holding the liquid developer on the holding member surface;

a supply section that causes the liquid developer which is stored in the storage section to flow at a predetermined flow velocity to supply the liquid developer to a developer tank;

a circulating section that causes the liquid developer which is discharged from the storage section to flow and circulate at a flow velocity faster than the flow velocity of the liquid developer which flows in the supply section;

a detecting section that detects a toner concentration of the liquid developer which flows in the circulating section; and an addition section that adds an adjustment agent which adjusts the toner concentration of the liquid developer to the liquid developer which is stored in the storage section.

2. The toner adjusting mechanism according to claim 1, further comprising:

a dispersion unit that disperses a toner which is contained in the liquid developer which has been collected from the holding member.

3. The toner adjusting mechanism according to claim 1, further comprising:

a receiving section that receives the liquid developer which is collected from the holding member;

a porous section through which the liquid developer passes; and a transporting member that, by moving, transports the liquid developer received by the receiving section to the porous section and causes the liquid developer to pass through the porous section, wherein the liquid developer which has passed through the porous section is stored in the storage section.

4. An image forming apparatus, comprising:

an image holding member that moves and on which an electrostatic latent image is formed;

a developer tank in which a liquid developer is stored;

a developing member that transfers the liquid developer stored in the developer tank with revolving to the image holding member, and develops the electrostatic latent image as a toner image;

a transfer member that transfers the toner image which is formed on the image holding member to a recording medium; and the toner adjusting mechanism according to claim 1 that adjusts a toner concentration of the liquid developer which remains on at least one of the developing member which serves as a holding member which holds the liquid developer, and the image holding member.

5. The toner adjusting mechanism according to claim 1, wherein the detecting section is an ultrasonic concentration sensor.

6. The toner adjusting mechanism according to claim 1, wherein the supply section comprises a first line through which the liquid developer stored in the storage section flows at the predetermined flow velocity to supply the liquid developer to the developer tank, and the circulating section comprises a second line separate from the first line through which the liquid developer stored in the storage section flows at the flow velocity faster than the predetermined flow velocity of the liquid developer flowing through the first line.

* * * * *